US008985518B2

(12) United States Patent
Zätterqvist

(10) Patent No.: US 8,985,518 B2
(45) Date of Patent: Mar. 24, 2015

(54) AIR GUIDING MEANS FOR A DISPENSER

(75) Inventor: Christer Zätterqvist, Uppsala (SE)

(73) Assignee: Saab AB, Linköping (SE)

( * ) Notice: Subject to any disclaimer, the term of this patent is extended or adjusted under 35 U.S.C. 154(b) by 472 days.

(21) Appl. No.: 13/377,299

(22) PCT Filed: Jun. 11, 2009

(86) PCT No.: PCT/SE2009/050717

§ 371 (c)(1),
(2), (4) Date: Dec. 9, 2011

(87) PCT Pub. No.: WO2010/144008

PCT Pub. Date: Dec. 16, 2010

(65) Prior Publication Data

US 2012/0091278 A1 Apr. 19, 2012

(51) Int. Cl.

| | |
|---|---|
| ***B64D 1/00*** | (2006.01) |
| ***F42B 5/155*** | (2006.01) |
| ***F42B 12/70*** | (2006.01) |
| ***F42B 4/26*** | (2006.01) |
| ***F42B 10/38*** | (2006.01) |
| ***F42B 12/62*** | (2006.01) |

(52) U.S. Cl.

CPC ..... *F42B 5/155* (2013.01); *F42B 12/70* (2013.01); *F42B 4/26* (2013.01); *F42B 10/38* (2013.01); *F42B 12/62* (2013.01)

USPC ..... 244/136; 244/53 B

(58) Field of Classification Search

USPC ..... 244/53 B, 136

See application file for complete search history.

(56) References Cited

U.S. PATENT DOCUMENTS

| | | | | | |
|---|---|---|---|---|---|
| 2,470,120 | A | * | 5/1949 | Walker | 89/1.54 |
| 3,511,457 | A | * | 5/1970 | Pogue | 244/137.3 |
| 3,547,000 | A | | 12/1970 | Haberkorn et al. | |
| 3,667,704 | A | | 6/1972 | Assmann | |
| 4,121,606 | A | | 10/1978 | Holland et al. | |
| 4,134,115 | A | * | 1/1979 | Strom | 342/12 |
| 4,167,008 | A | | 9/1979 | Blickenstaff | |
| 4,424,733 | A | * | 1/1984 | Degen | 89/1.51 |
| 4,522,104 | A | * | 6/1985 | Degen | 89/1.51 |
| 5,271,523 | A | * | 12/1993 | Nasvall et al. | 221/185 |

(Continued)

FOREIGN PATENT DOCUMENTS

| | | | |
|---|---|---|---|
| EP | 0511946 | A1 | 11/1992 |
| EP | 1950522 | A1 | 7/2008 |
| GB | 2023263 | A | 12/1979 |
| WO | WO-02/093102 | A1 | 11/2002 |

OTHER PUBLICATIONS

Supplementary European Search Report—Feb. 13, 2014 (Issued in Counterpart Application No. 09845907.6).
PCT/ISA/210—International Search Report—Feb. 17, 2010.
PCT/ISA/237—Written Opinion of the International Searching Authority—Feb. 17, 2010.

*Primary Examiner* — Tien Dinh
*Assistant Examiner* — Steven Hawk
(74) *Attorney, Agent, or Firm* — Venable LLP; Eric J. Franklin

(57) ABSTRACT

An air guide for a dispenser. At least one air scoop is configured to guide an air stream to a feeding out opening for chaffs on the dispenser in order to facilitate packages of chaffs to be released from the dispenser. A control unit is configured to control the air stream through the at least one air scoop.

8 Claims, 5 Drawing Sheets

(56) References Cited

U.S. PATENT DOCUMENTS

| | | | | |
|---|---|---|---|---|
| 5,773,745 | A | 6/1998 | Widmer | |
| 6,539,833 | B1 * | 4/2003 | Zatterqvist | 89/1.51 |
| 7,373,886 | B2 * | 5/2008 | Zatterqvist et al. | 102/505 |
| 8,485,467 | B2 * | 7/2013 | Gemma | 244/53 B |
| 2013/0248657 | A1 * | 9/2013 | Riordan | 244/53 B |

* cited by examiner

AIR GUIDING MEANS FOR A DISPENSER

CROSS-REFERENCE TO RELATED APPLICATIONS

This application is the national phase under 35U.S.C. §371 of PCT/SE2009/050717 filed 11 Jun. 2009.

TECHNICAL FIELD

The present invention relates to an air guiding means for a dispenser.

BACKGROUND ART

Dispenser units arranged to dispense countermeasures from aircrafts are well known. Both fighter and transport aircrafts, as well as civil aircrafts are exposed for threats from self-guided missiles equipped with radar, IR or laser sensors, which can be fired either from other aircrafts or from the ground. In order to protect the threatened aircrafts from an attack of such missiles they are provided with various types of dispenser units which dispense countermeasure means. Such countermeasure means may comprise aluminized foil or fibers, pyrophoric IR materials, flares and also laser-reflecting fibers or foils, which confuse and divert missiles aimed at the aircraft.

Document EP-A1-0511946 discloses a dispenser for feeding out packages containing chaff, which dispenser may be arranged on an aircraft. The dispenser is provided with air guiding means in order to create a pressure difference at a feeding out opening pulling out the packages in the air stream behind the dispenser. The air guiding means are air scoops provided with an air inlet in connection to the side of the dispenser and an air outlet in connection to the feeding out opening.

Commonly, the dispenser is applied on the under side of an aircraft, preferably an airplane, and has an elongated body shape with its longitudinal direction coinciding with the flight direction of the air craft. The elongated body is exposed to air streaming having a speed corresponding to the flight speed of the aircraft. The feeding out opening of a magazine for packages provided with chaffs terminates in the rear section of the dispenser. During a flight a wake is formed behind the feeding out opening. Immediately behind the dispenser, the wake has a sectional area of the same order of magnitude as the sectional area of the dispenser. The formation of this wake inter alia influences on the separation time of the packages with chaffs, which is the time required for the package located closest to the feeding out opening to separate from the rest of the packages in the magazine and to leave the feeding out opening.

However, the packages containing chaff are only fed out at moments when the aircraft is under attack or at moments when the aircraft is under a potential threat. Therefore, the air guiding means in form of air scoops have no function when the dispenser is inactivated and the packages containing chaff are not fed out from the dispenser. During a mission the feeding out packages containing chaff takes place under a relatively short period of time in relation to the overall flight time of the mission. As a result, the need of the air scoops is only limited to a relatively short period of time in relation to the overall flight time of the mission.

The air scoops have a negative influence on the air drag and therefore the fuel consumption of the aircraft will increase. As a result, the operation range of the aircraft will decrease when the fuel consumption increases. Also, the air scoops could create noise which may be detected by an enemy in order to detect the position of the aircraft.

The objective problem to be solved by the present invention is therefore to reduce the air drag of the air scoops when the dispenser is not activated.

Another objective problem to be solved by the present invention is to reduce noise created by the air scoops when the dispenser is not activated.

SUMMARY OF THE INVENTION

The above-mentioned objects are achieved by an air guiding means for a dispenser.

When controlling the air stream by means of the control means through the air scoops there is a possibility to reduce the air drag from the air scoops when the dispenser is not activated. Therefore, there is also a possibility to increase the operation range of the aircraft. Also, there is a possibility to reduce or even to eliminate the noise created by the air scoops when the dispenser is not activated.

According to a first embodiment of the invention the control means is arranged to move the air scoop in order to open and close the air inlet. When the dispenser is not activated the air scoop can be moved to a position in relation to the body of the dispenser where the air drag is reduced.

According to a second embodiment of the invention a deflector means is connected to the control means and the control means is arranged to move the deflector means in order to open and close the air inlet. When the dispenser is not activated the deflector means can be moved to a position in relation to the body of the dispenser where the air drag is reduced.

The control means can be of any type of power generating means such as a pneumatic cylinder, hydraulic cylinder and/or an electrical motor.

BRIEF DESCRIPTION OF THE DRAWINGS

Further advantages and features of the invention can be derived from the following detailed description of exemplary embodiments of the invention, with reference to the drawings.

DETAILED DESCRIPTION

Figure 1:
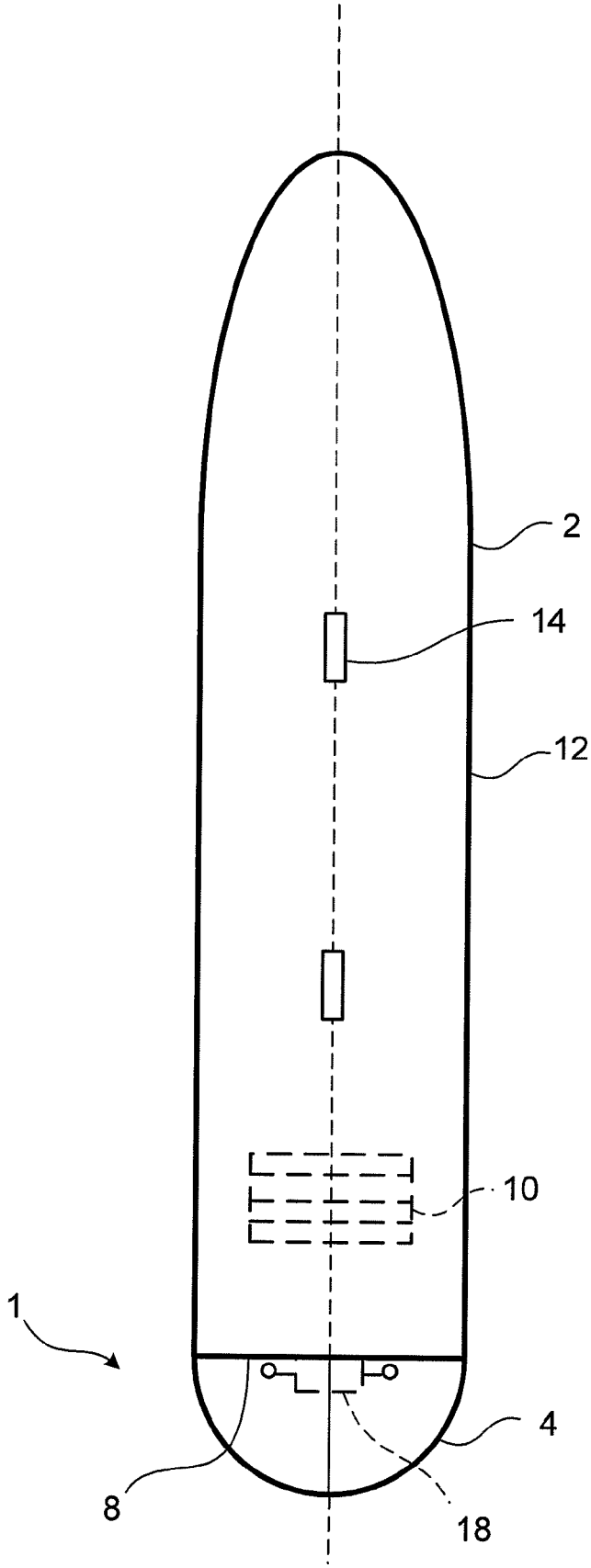
FIG. 1 shows a view from above of a first embodiment of an air guiding means for a dispenser according to the present invention in which the air guiding means are brought to a position when the dispenser is not activated.

FIG. 1 shows a view from above of a first embodiment of an air guiding means 1 for a dispenser 2 according to the present invention in which the air guiding means 1 are brought to a position when the dispenser 2 is not activated. The air guiding means 1 comprises at least one air scoop 4 to guide an air stream 6 to a feeding out opening 8 for packages of chaff 10 on the dispenser 2 in order to facilitate the packages 10 to be released from the dispenser 2, which is described above. According to the embodiment disclosed in FIG. 1 two air scoops 4 are arranged at the body 12 of the dispenser 2. Also, suspension means 14 are arranged on the body 12 of the dispenser 2 for suspending the dispenser 2 on an aircraft 16, which is described in connection to FIG. 5 below.

A control means 18 is provided for controlling the air stream 6 through the air scoops 4. The control means 18 can be a pneumatic cylinder, hydraulic cylinder and/or an electrical motor. According to the disclosed embodiment one control means 18 is arranged to control both air scoops 4. However, it is also possible to arrange a separate control means 18 for each air scoop 4.

Figure 2:
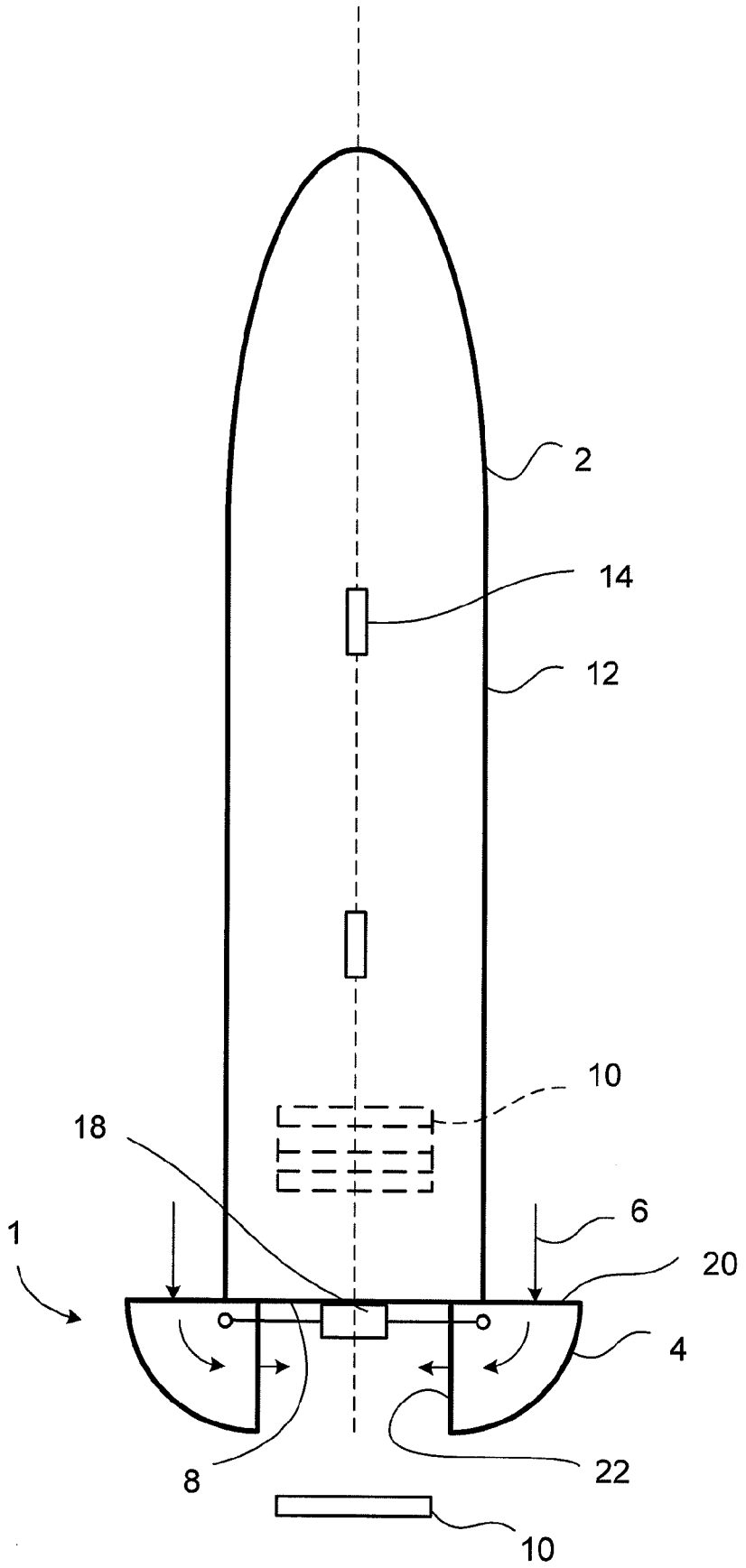
FIG. 2 shows a view from above of the first embodiment of the air guiding means for the dispenser according to the present invention in which the air guiding means are brought to a position when the dispenser is activated.

FIG. 2 shows a view from above of the first embodiment of the air guiding means 1 for the dispenser 2 according to the present invention in which the air guiding means 1 are brought to a position when the dispenser 2 is activated. It should be understood that when the dispenser 2 is activated the dispenser 2 is ready to dispense packages of chaffs 10. In this activated position the air scoops 4 guide the air stream 6 to the feeding out opening 8 for chaffs. Each air scoop 4 comprises an air inlet 20 and an air outlet 22. As disclosed in FIG. 2 the air inlet 20 is exposed for the air stream 6 which is created when the aircraft 16 is in the air and has an operation speed. The air stream 6 enters the air inlet 20, is guided approximately 90 degrees by the air scoops 4 and leaves the air outlet 22 which is situated at the feeding out opening 8 for the chaffs. When the dispenser 2 is activated and packages of chaffs 10 are to be dispensed the air scoops 4 are put into the position by the control means 18 in order to direct the air stream 6 to the feeding out opening 8 for the chaffs. The directed air steam 6 creates a pressure difference behind the dispenser 2 at the feeding out opening 8 for the chaffs, which pressure difference acts to remove the packages of chaffs 10 released at the feeding out opening 8. This results in a reduced separation time and a distinct separation of chaffs which may be dispensed in a subsequent order.

The control means 18 is arranged to close and open the air inlet 20 in order to controlling the air stream 6 trough the air scoops 4. When controlling the air stream 6 by means of the control means through the air scoops 4 there is a possibility to reduce the air drag from the air scoops 4 when the dispenser 2 is not activated. As a result, there is also a possibility to increase the operation range of the aircraft 16. Also, there is a possibility to reduce or even to eliminate noise created by the air scoops 4 when the dispenser 2 is not activated. Hence, the air inlet 20 is so closed that the air drag from the air stream 6 is reduced in relation to when the air inlet 20 is opened. According to the first embodiment the control means 18 is so arranged to move the air scoops 4 in order to open and close the air inlet 20. As disclosed in FIG. 1 the control means 18 is so arranged to move the air scoops 4 into a position where the air inlet 20 is closed by the body 12 of the dispenser 2. The air scoops 4 are hidden behind the body 12 of the dispenser 2, so that the air stream 6 will pass the dispenser 2 without entering the air inlet 20 of the air scoops 4 thereby avoiding the energy loss otherwise experienced when deflecting an air stream 6 through the air scoop 4.

Figure 3:
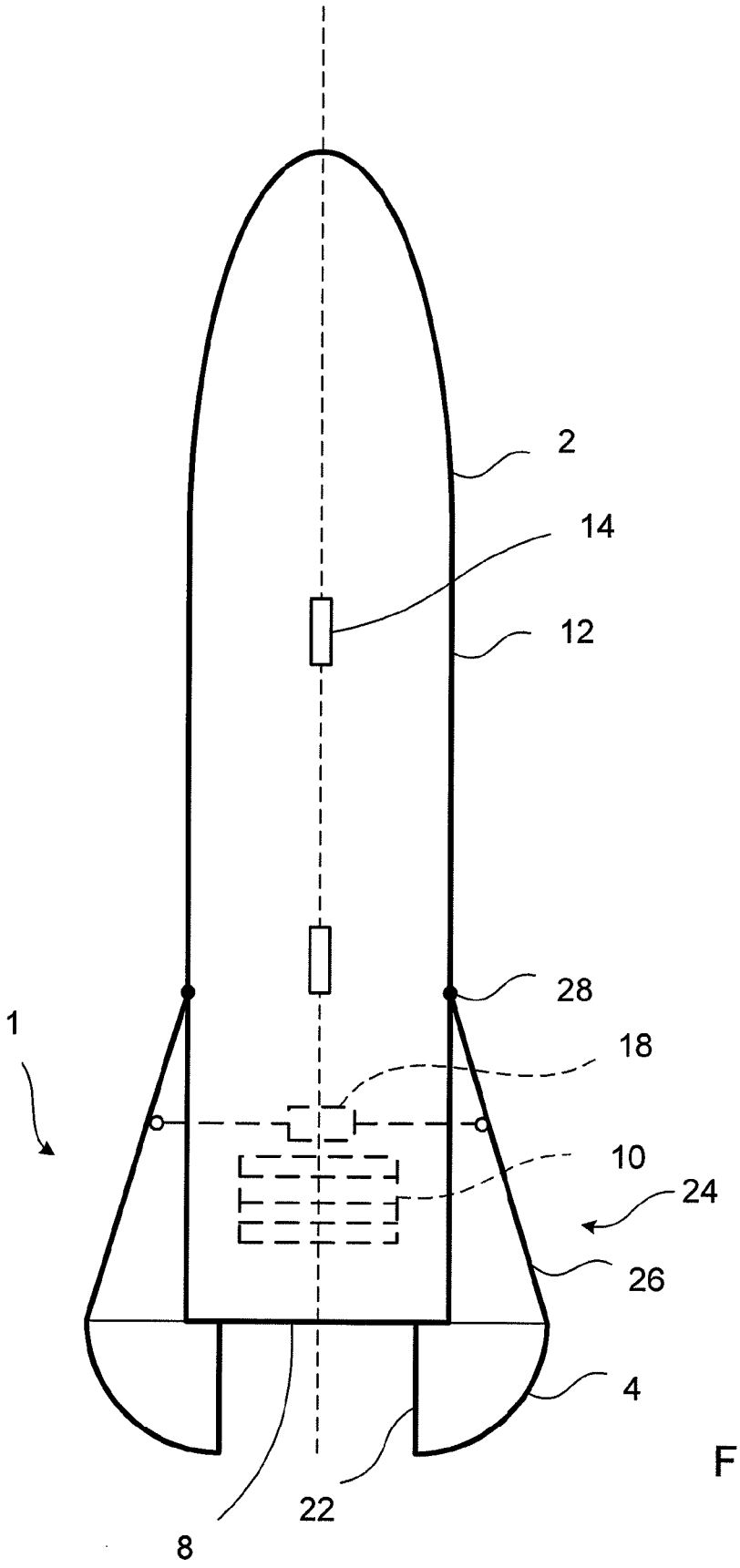
FIG. 3 shows a view from above of a second embodiment of an air guiding means for a dispenser according to the present invention in which deflector means are brought to a position when the dispenser is not activated.

FIG. 3 shows a view from above of a second embodiment of an air guiding means 1 for a dispenser 2 according to the present invention in which deflector means 24 are brought to a closing position of the air inlets 20 when the dispenser 2 is not activated. I this embodiment two deflector means 24 are connected to the control means 18 and the control means 18 is arranged to move the deflector means 24 in order to open and close the air inlet 20.

Preferably each deflector means 24 are a part of a wall section 26 of the dispenser body 12. However, the deflector means 24 may also be separate wall sections 26 arranged on the outside of the body 12 of the dispenser 2. The deflector means may be pivotally hinged to the dispenser body 12 by means of hinges 28.

Figure 4:
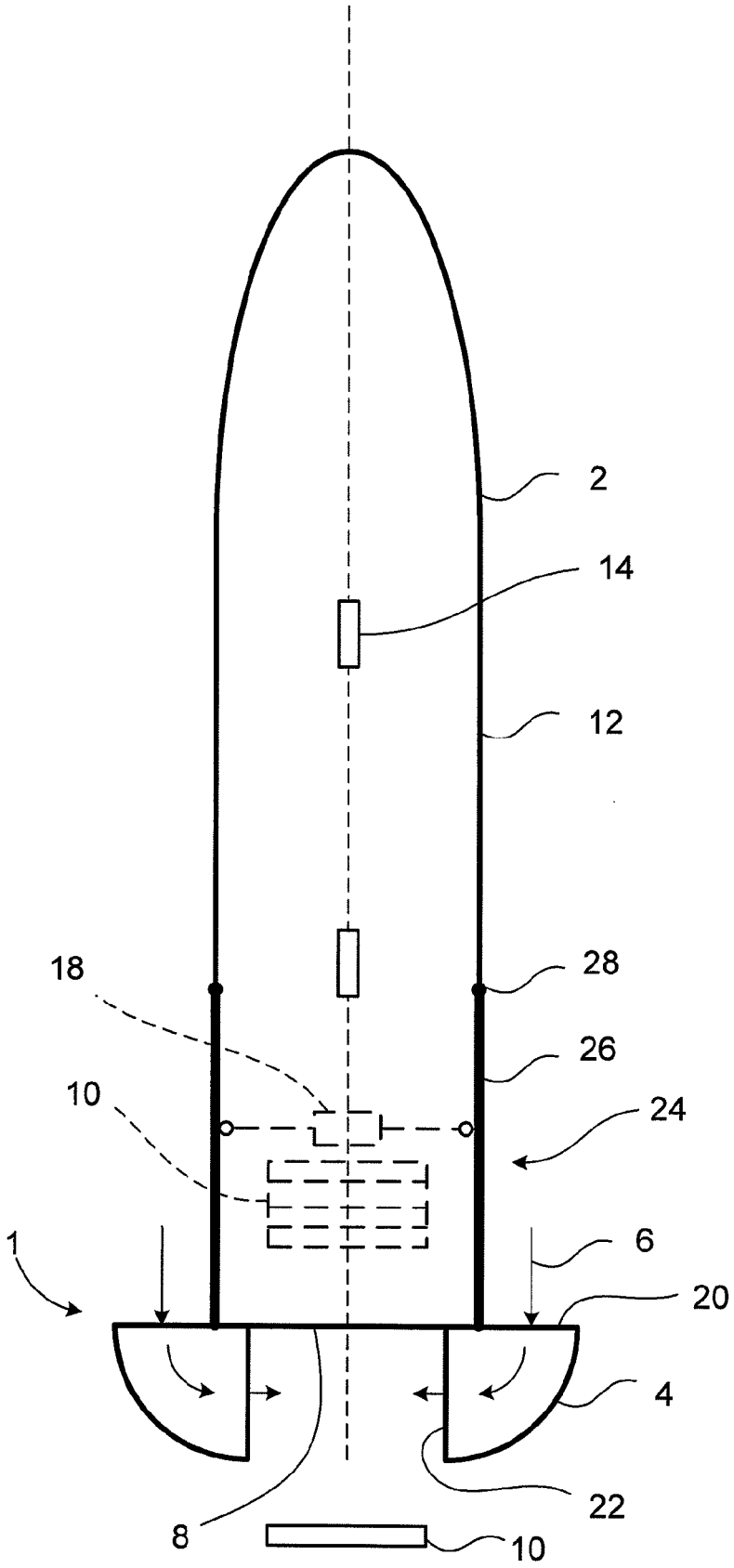
FIG. 4 shows a view from above of the second embodiment of the air guiding means for a dispenser according to the present invention in which the deflector means are brought to a position when the dispenser is activated.

FIG. 4 shows a view from above of the second embodiment of the air guiding means 1 for a dispenser 2 according to the present invention in which the deflector means 24 are brought to a position when the dispenser 2 is activated.

Figure 5:
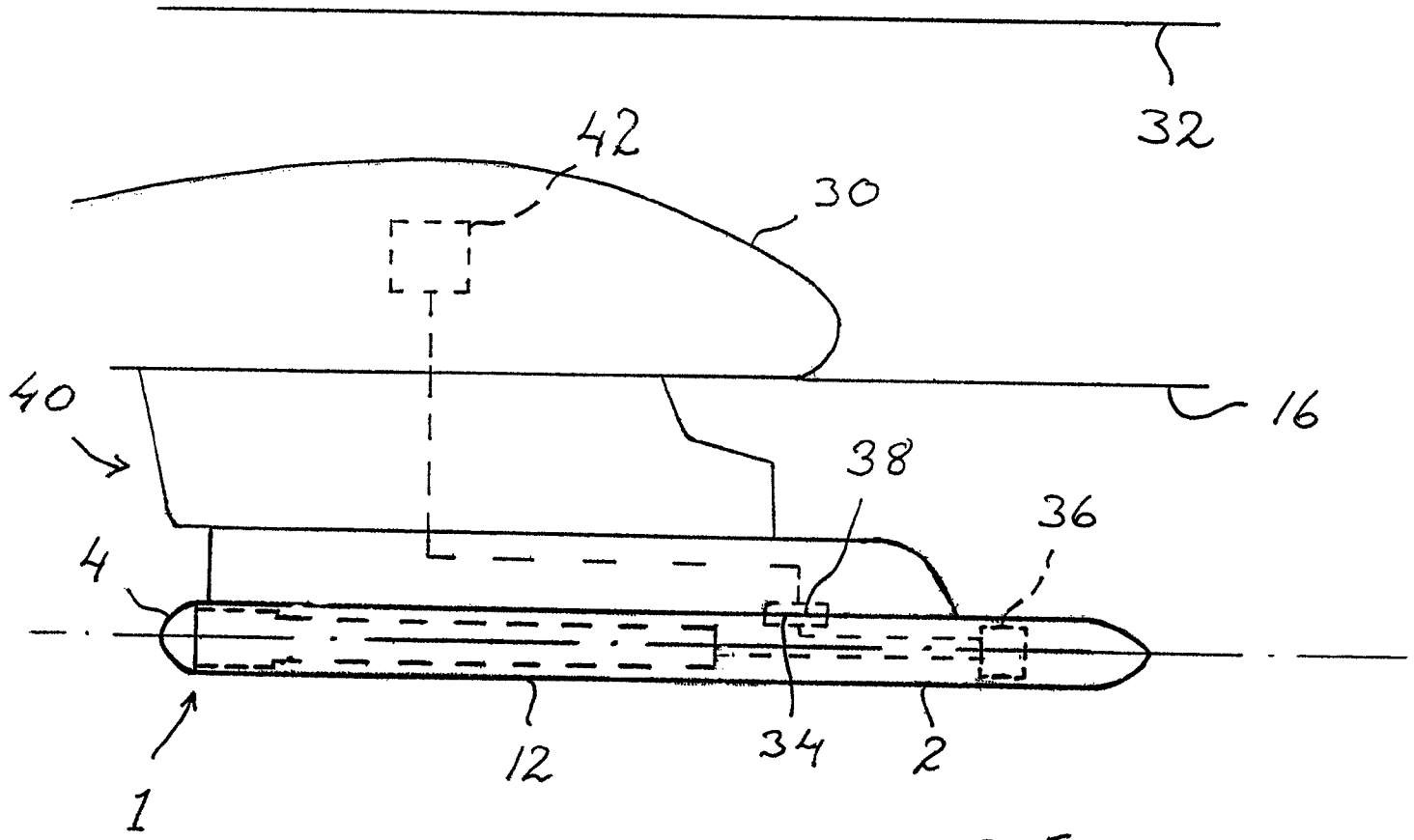
FIG. 5 shows a side view of an aircraft on which a dispenser provided with air guiding means according to the present invention is arranged.

FIG. 5 shows a side view of an aircraft 16 on which a dispenser 2 provided with air guiding means 1 according to the present invention is arranged. The dispenser 2 may be suspended under a wing 30 or under the fuselage 32 of the aircraft 16.

First electrical terminals 34 are arranged at the suspension means 14, which are connected to a first control system 36 for controlling the dispenser 2. When arranging the first electrical terminals 34 at the suspension means 14 of the dispenser 2 electrical power and control signals can be supplied to the first control system 36 and to the dispenser 2. The first electrical terminals 34 are adapted to mate with second electrical terminals 38 on a hard point 40 on the aircraft 16. As a result a transmission of power and control signals between the aircraft 16 and the dispenser 2 is possible. The first control system 36 is adapted to communicate with a second control system 42 on the aircraft 16. The first control system 36 of the dispenser 2 is connected to the control means 18 for controlling the air stream 6 through the air scoops 4. Thus, when packages of chaffs 10 are to be dispensed from the dispenser 2 signals are sent from the first control system 36 of the dispenser 2 to the control means 18 in order to move the air scoops 4 according to the first embodiment or to move the deflector means 24 according to the second embodiment.

Parts and details of the different embodiments may be combined and arranged together.

The invention claimed is:

1. An air guide for a dispenser, the air guide comprising:

at least one air scoop arranged to guide an air stream to a feeding out opening for chaffs on the dispenser in order to facilitate packages of chaffs to be released from the dispenser, wherein the at least one air scoop comprises an air inlet arranged to move between an open and a closed position, wherein with the air inlet in the closed position the air stream passes the dispenser without entering the air inlet, and at least one control unit arranged to control the air stream through the at least one air scoop by opening and closing the air inlet.

2. The air guide according to claim 1, wherein the control unit is arranged to move the at least one air scoop into a position where the air inlet is closed by the body of the dispenser.

3. The air guide according to claim 1, further comprising:

a deflector connected to the control unit, wherein the control unit is configured to move the deflector in order to open and close the air inlet.

4. The air guide according to claim 3, wherein the deflector is a wall section.

5. The air guide according to claim 4, wherein the deflector is a wall section of the dispenser body.

6. The air guide according to claim 1, wherein the control unit is at least one of a pneumatic cylinder, hydraulic cylinder or an electrical motor.

7. The air guide according to claim 1, wherein the air guide comprises two air scoops.

8. The air guide according to claim 1, wherein the air guide comprises a plurality of this control units, wherein a control unit is associated with each air scoop.

* * * * *